US005791762A

United States Patent [19]

Wroblewski

[11] Patent Number: 5,791,762

[45] Date of Patent: Aug. 11, 1998

[54] WINDOW DISPLAY LIGHTING SYSTEM

[75] Inventor: Steven Wroblewski, Darien, Ill.

[73] Assignee: Techworks, Downers Grove, Ill.

[21] Appl. No.: 595,379

[22] Filed: Feb. 1, 1996

[51] Int. Cl.[6] ..... F21V 21/00

[52] U.S. Cl. ..... 362/152; 362/249; 362/250; 362/252

[58] Field of Search ..... 362/145, 151, 362/152, 219, 249, 250, 252, 285, 368, 372, 418, 806

[56] References Cited

U.S. PATENT DOCUMENTS

| | | | |
|---|---|---|---|
| 2,667,323 | 1/1954 | Mason | 362/387 |
| 3,633,023 | 1/1972 | Castiglione . | |
| 3,836,760 | 9/1974 | Robinson . | |
| 4,244,014 | 1/1981 | Van Ess . | |
| 4,335,422 | 6/1982 | Van Ess . | |
| 4,357,653 | 11/1982 | Kovacs . | |
| 4,821,158 | 4/1989 | Mitten . | |
| 4,852,832 | 8/1989 | Delaney . | |
| 4,901,212 | 2/1990 | Prickett . | |
| 4,995,181 | 2/1991 | Wolf . | |
| 5,018,055 | 5/1991 | Wu . | |
| 5,067,061 | 11/1991 | Prickett . | |
| 5,103,382 | 4/1992 | Kondo et al. | 362/372 |
| 5,404,279 | 4/1995 | Wood . | |
| 5,437,504 | 8/1995 | Halvatzis . | |

*Primary Examiner*—Y My Quach
*Attorney, Agent, or Firm*—Hill & Simpson

[57] ABSTRACT

A window display lighting system is provided. The system has a housing with a longitudinal interior channel. The system also has several modular light holders arranged within the longitudinal interior channel and a compressible part for resiliently holding the housing in the window. The system is capable of holding a string of Christmas lights, for example, in an evenly spaced manner in a frame of a window. The installation thereof does not require any tools or materials. The system is adaptable to fit in a range of window sizes.

19 Claims, 2 Drawing Sheets

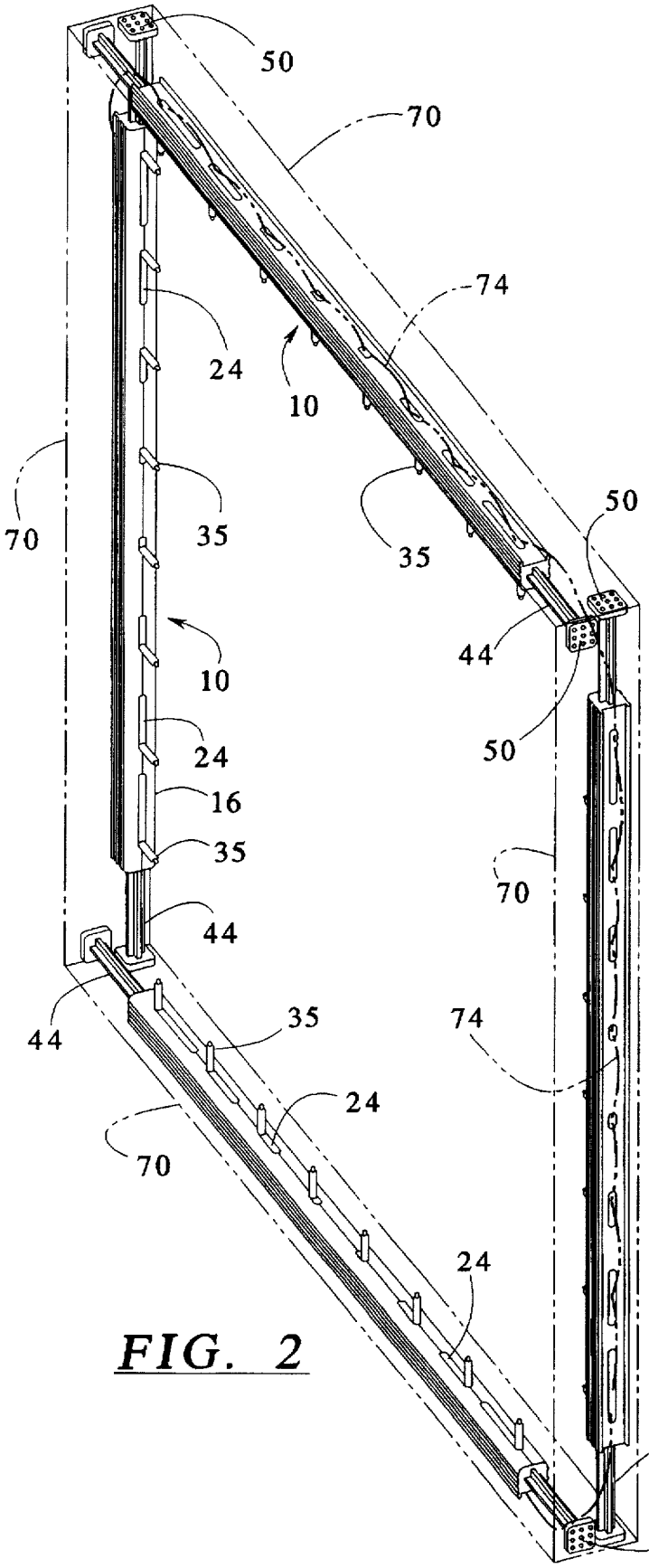
FIG. 2
FIG. 3
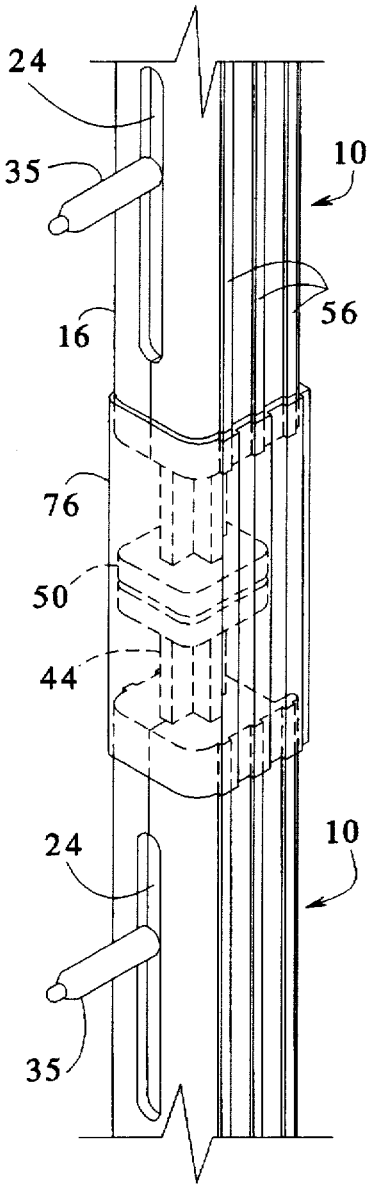

WINDOW DISPLAY LIGHTING SYSTEM

BACKGROUND OF THE INVENTION

This invention relates generally to a lighting display frame for a window or door and more specifically to a window display lighting support system capable of evenly distributing the lights in a window as well as providing a simple installation thereof.

Strings of ornamental lights, such as Christmas tree lights, are typically used on Christmas trees. Of course, many people frequently use the lights in various other locations in the home during the holiday season. Many people enjoy the decorative effect of the lights when hung in windows or doors. Although the lights are quite attractive when installed, the installation of a string of lights in a window is usually a difficult activity for most people. Neither the strings of lights nor the windows are designed with the idea of simply mounting the lights into the windows. As a result, most people improvise by using wires, nails, tape or adhesives to fasten the strings of lights into the window frame. These makeshift approaches are often unreliable and typically result in damage to either the structure or the window. In addition, the strings of lights are usually found in a tangled mess of wires which are difficult to handle. Furthermore, most people do not have the skills or the tools necessary to neatly mount a string of Christmas lights into a window or door in a reliable manner.

A need has arisen, therefore, to provide a window display lighting system for conveniently installing a string of lights in a window or other location which is easy to use, attractive when installed and does not cause damage to the structure or finish of the window.

SUMMARY OF THE INVENTION

To this end, the present invention provides a window display lighting system that is easy to install, attractive when installed and usable without damaging the structure or finish of the window. The system further provides for automatic, even spacing of the lights in the window frame.

In an embodiment of the present invention, a window display lighting system is provided. The system has a housing and means for holding the housing in the window. The holding means adjustably arranges and holds a plurality of lights in the housing. The holding means is located substantially within the housing.

In an embodiment, the system further comprises a channel located in the housing wherein the means for holding is located substantially within the channel.

In an embodiment, the system further comprises a plurality of openings of different sizes formed in the housing through which the plurality of lights project.

In an embodiment, the system further comprises means for connecting the window display lighting system to a second window display lighting system.

In an embodiment, the system further comprises an end face located at each end of the holding means.

In an embodiment, the system further comprises a plurality of modular holders contained in the housing.

In an embodiment, the system further comprises spring means for evenly spacing the plurality of lights within the housing.

In an embodiment, the system further comprises an end cap connected to the holding means.

In an embodiment, the system further comprises spring means for adjusting the length of the means for holding the housing in the window.

In an embodiment, the system further comprises means for guiding the means for holding constructed and arranged in the housing.

In another embodiment of the present invention, a window display lighting system is provided. The system has a housing with walls defining a longitudinal interior channel. A plurality of modular light holders are arranged in the longitudinal interior channel. The system also has compressible means for resiliently holding the housing in the window.

In an embodiment, the system further comprises a plurality of openings formed in the housing through which the plurality of lights project.

In an embodiment, the system further comprises an end face located at each end of each light holder.

In an embodiment, the system further comprises means located in the housing for guiding the compressible means and the plurality of modular light holders.

In an embodiment, the system further comprises spring means between the plurality of modular light holders within the housing.

In an embodiment, the system further comprises end caps connected to the means for holding the housing in the window.

In an embodiment, the system further comprises adaptive means for securely holding different sizes of lights.

In an embodiment, a method for installing lights in a frame is provided. The method has the steps of: providing a display lighting system having a housing with an interior, a plurality of modular light holders arranged in the interior of the housing and adjustable means for holding the housing in the frame; inserting a plurality of lights into the plurality of modular light holders; and compressing the adjustable means to an appropriate length to fit in the frame.

In an embodiment, the method further comprises the step of evenly spacing the plurality of lights in the frame.

It is, therefore, an advantage of the present invention to provide a simple to assemble window lighting display system that uses an ordinary string of Christmas tree lights.

Another advantage of the present of invention is to provide a window display lighting system which is easy to use and to adjust.

It is another advantage of the present invention to provide a window display lighting system that provides a neat, clean appearance to the window.

It is a further advantage of the present invention to provide a window display lighting system that is adjustable and adaptable to different size windows.

Another advantage of the present invention is to provide a window display lighting system that is capable of hiding the wires for a clean display.

It is another advantage of the present invention to provide a window display lighting system that has low manufacturing costs.

Still another advantage of the present invention is to provide a window display lighting system that is quick and simple to install.

It is another advantage of the present invention to provide a window display lighting system that is capable of holding different size lights.

It is yet another advantage of the present invention to provide a window display lighting system that includes a holder with an integrated spring to automatically adjust the lights so that they are evenly spaced in the window frame.

It is another advantage of the present invention to provide a window display lighting system that is non-damaging to the window frame.

Moreover, it is an advantage of the present invention to provide a window display lighting system that requires no extra parts or tools for installation.

It is another advantage of the present invention to provide a window display lighting system that is safe and durable.

Finally, it is another advantage of the present invention to provide a window display lighting system that prevents any tangled wires.

Additional features and advantages of the present invention are described in, and will be apparent from, the detailed description of the presently preferred embodiments and from the drawings.

BRIEF DESCRIPTION OF THE DRAWINGS

FIG. 2 is a front view of a window environment in which an embodiment of the window display lighting system or the present invention is securely held.

FIG. 3 is an enlarged detail view of an embodiment of a bracket that can be used to connect two systems together end-to-end.

DETAILED DESCRIPTION OF THE PRESENTLY PREFERRED EMBODIMENTS

Figure 1:
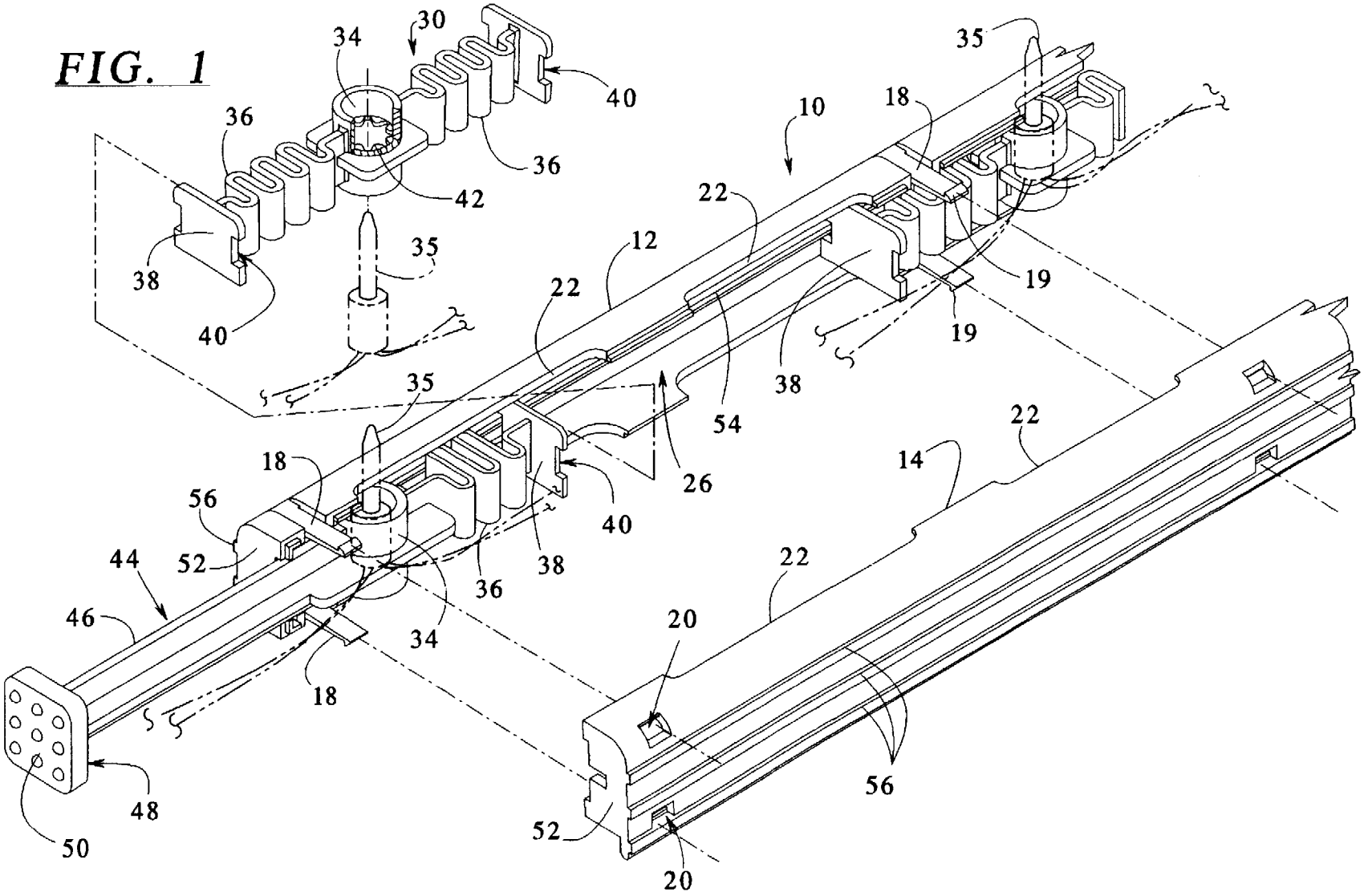
FIG. 1 is a partially exploded perspective view of an embodiment of a window display lighting system of the present invention.

The present invention provides a window display lighting support system capable of evenly distributing a string of Christmas lights in a window as well as providing a simple manner of installing the system. The lights are evenly distributed across the window frame and no tools or fasteners are needed.

Referring now to the figures, FIG. 1 is an exploded view of the components of an embodiment of the window display lighting support system generally at 10. In the embodiment illustrated in FIG. 1, the system 10 has a male housing part 12 which cooperatively connects to a female housing part 14 to form a housing 16 when connected (see FIG. 2). The male part 12 has a plurality of tabs 18 located at regular intervals along the length of the male housing part 12. The plurality of tabs 18 individually insert into a plurality of tab slots 20 in the female housing part 14 when the housing parts 12, 14 are connected to form the housing 16. In addition, each tab 18 is equipped with a catch 19 at an end thereof. The catch 19 prevents the male housing part 12 from being detached from the female housing part 14 once connected. However, the tab 18 is flexible so that the male housing part 12 can be subsequently separated from the female housing part 14, if desired.

In addition, the male housing part 12 and the female housing part 14 have a plurality of longitudinal notches 22 located along the top and the bottom of each housing part 12, 14 so that when the housing parts 12, 14 are connected, the notches 22 align to form longitudinal apertures 24 (see FIG. 2). The notches 22 shown in the embodiment of FIG. 1 vary in size. The notches 22 increase in size from the center outward toward the ends of the housing 16. The reason for this size variation is explained below.

When the male housing part 12 is connected to the female part 14, an interior 26 is formed in the housing 16. A plurality of modular light holders 30 are located within the interior 26 of the housing 16. In the embodiment illustrated, each modular holder 30 has a socket 34 to hold, for example, a Christmas light 35. In addition, each holder 30 has a spring means 36 on each end of the socket 34. The spring means 36 illustrated in FIG. 1 is integrally molded with the socket 34. However, other spring means could be used. A first end of the spring means 36 is connected to the socket 34 and a second end of the spring means 36 is connected to an end plate 38. The end plate 38 preferably has a notch 40 for aligning the modular holder 30 in the interior 26 of the housing 16.

In addition, the light socket 34, in an embodiment, has adjustment means 42 for holding various sizes of lights. The adjustment means 42 may be, for example, flexible teeth that grab the light 35 and flex to provide a secure connection to the light 35.

Also illustrated in FIG. 1, is an adjustable support means 44 located within the interior 26 of the housing 16 at each end thereof. The support means 44 also has the light socket 34, as well as the spring means 36 at an end thereof and the end plate 38 having the notch 40. The end plate 38 of the support means 44 abuts the end plate 38 of the modular holder 30 when located in the interior 26 of the housing 16.

In addition, the support means 44 has a shaft portion 46 having an end 48. The end 48 also has, in an embodiment, an end cap 50 that mounts to the end 48 to provide better grip when the support system 10 is placed in a window frame. The end cap 50 is preferably an elastomer or other plastic or rubber material with good gripping capabilities or characteristics. As illustrated, the shaft portion 46 of the support means 44 extends outside an end face 52 of the housing 16.

Also, the interior 26 of the housing 16, in an embodiment, has a longitudinal rail 54 which guides the notches 40 on the end plates 38 of the modular holders 30 and the support means 44 to keep the same aligned within the interior 26 of the housing 16. Further, longitudinal ribs 56 are provided on the exterior of the male housing part 12 and the female housing part 14 of the housing 16 to provide added structural strength to the support system 10.

FIG. 2 illustrates the window display lighting support system 10 in an environment of use. Such an environment includes a window or door frame. FIG. 2 illustrates a window frame 70 in which an embodiment of the present invention is securely mounted. As stated above, it is a distinct advantage of the present invention that the system 10 may be easily mounted without the use of any tools or adhesives or other fasteners.

For example, to install the window display lighting system 10 of the present invention in the window frame 70, the user simply presses the individual lights 35, usually provided as a connected string of lights into the light sockets 34 of the present invention. The complete system 10 is then placed in the desired location of the window frame 70. The support means 44 is compressed inwardly toward the center of the housing 16. In doing so, all of the spring means 36 compress such that the light sockets 34 are evenly spaced along the length of the housing 16. As is apparent, the lights 35 then project through the longitudinal apertures 24 to be displayed. The longitudinal apertures 24 are longer at the ends than in the center of the housing 16 so that more compression travel occurs at the ends as opposed to the center region of the interior 26 of the housing 16. This is due to the added compression caused by greater numbers of spring means 36 present near the center of the housing 16. A power cord 74 connecting the lights 35 together is concealed beneath the housing 16 so that virtually no wire shows to detract from the neat arrangement of the window display lighting support system 10 of the present invention. Also, the end cap 50 provides added grip and friction so that the lighting support system 10 remains captured in the window frame 70 once the system 10 is compressed to fit the width of the window frame 70.

While the invention, as set forth, is capable of being mounted into windows of varying sizes, in the event that the user selects a larger window or door for displaying the lighting support system 10, more than one support system 10 can be connected end-to-end longitudinally to provide a greater length. FIG. 3 illustrates an embodiment of a bracket 76 that can be used to provide added stability to connect two lighting systems 10 thereby to preventing buckling of the system 10.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A lighting system for display in a window, the system comprising:

a housing;

means for holding the housing in the window wherein the means for holding adjustably arranges and holds a plurality of lights in the housing, the means for holding located substantially within the housing; and a plurality of openings of different sizes formed in the housing through which the plurality of lights project.

2. The system of claim 1 further comprising:

a channel located in the housing wherein the means for holding is located substantially within the channel.

3. The system of claim 1 further comprising:

means for connecting the window display lighting system to a second window display lighting system.

4. The system of claim 1 further comprising:

an end face located at each end of the means for holding.

5. The system of claim 1 further comprising:

a plurality of modular holders contained in the housing.

6. A lighting system for displaying in a window, the system comprising:

a housing having walls defining a longitudinal interior channel therein;

a plurality of modular light holders arranged in the longitudinal interior channel;

compressible means for resiliently holding the housing in the window; and means located in the housing for guiding the compressible means and the plurality of modular light holders.

7. The system of claim 6 further comprising:

a plurality of openings formed in the housing through which a plurality of lights in the modular light holders project.

8. The system of claim 6 further comprising:

means for connecting the window display lighting system to a second window display lighting system.

9. The system of claim 6 further comprising:

an end face located at each end of each light holder.

10. The system of claim 6 further comprising:

end caps connected to the compressible means holding the housing in the window.

11. The system of claim 6 further comprising:

adaptive means in the plurality of modular light holders for securely holding different sizes of lights.

12. A method for installing lights in a frame, the method comprising the steps of:

providing a display lighting system having a housing with an interior, a plurality of modular light holders arranged in the interior of the housing and adjustable means for holding the housing in the frame;

inserting a plurality of lights into the plurality of modular light holders;

guiding the adjustable means and the plurality of modular light holders in the housing; and compressing the adjustable means to an appropriate length to fit in the frame.

13. The method of claim 12 further comprising the step of:

evenly spacing the plurality of lights in the frame.

14. A lighting system for display in a window, the system comprising:

a housing;

means for holding the housing in the window wherein the means for holding adjustably arranges and holds a plurality of lights in the housing, the means for holding located substantially within the housing; and spring means constructed and arranged in the housing to evenly space the plurality of lights within the housing.

15. A lighting system for display in a window, the system comprising:

a housing;

means for holding the housing in the window wherein the means for holding adjustably arranges and holds a plurality of lights in the housing, the means for holding located substantially within the housing; and an end cap connected to the means for holding the housing in the window.

16. A lighting system for display in a window, the system comprising:

a housing;

means for holding the housing in the window wherein the means for holding adjustably arranges and holds a plurality of lights in the housing, the means for holding located substantially within the housing; and spring means for adjusting a length of the means for holding the housing in the window.

17. A lighting system for display in a window, the system comprising:

a housing;

means for holding the housing in the window wherein the means for holding adjustably arranges and holds a plurality of lights in the housing, the means for holding located substantially within the housing; and means constructed and arranged in the housing for guiding the means for holding.

18. A lighting system for display in a window, the system comprising:

a housing having walls defining a longitudinal interior channel therein;

a plurality of modular light holders arranged in the longitudinal interior channel;

compressible means for resiliently holding the housing in the window; and spring means between the plurality of modular light holders within the housing.

19. A lighting system for display in a window, the system comprising:

a housing having walls defining a longitudinal interior channel therein;

a plurality of modular light holders arrange in the longitudinal interior channel;

compressible means for resiliently holding the housing in the window; and adaptive means within the plurality of modular light holders for securely holding different sizes of lights.

* * * * *